United States Patent [19]

Berfield

[11] Patent Number: 4,906,265

[45] Date of Patent: Mar. 6, 1990

[54] FILTER AND INSTALLATION MEANS FOR DRY MATERIAL FILTER FOR ELECTRIC VACUUM CLEANER

[75] Inventor: Robert C. Berfield, Jersey Shore, Pa.

[73] Assignee: Shop-Vac Corporation, Williamsport, Pa.

[21] Appl. No.: 296,573

[22] Filed: Jan. 12, 1989

[51] Int. Cl.[4] ..... B01D 46/02; B31B 49/04

[52] U.S. Cl. ..... 55/379; 55/380; 55/381; 55/486; 55/498; 493/186; 493/941

[58] Field of Search ..... 55/216, 486, 498, DIG. 3, 55/274, 379, 380, 381; 493/186, 243, 267, 268, 941

[56] References Cited

U.S. PATENT DOCUMENTS

| | | | |
|---|---|---|---|
| 90,107 | 5/1869 | Kimball | 493/103 |
| 945,205 | 1/1910 | Webb | 55/428 |
| 2,863,524 | 12/1958 | Buda | 55/216 |
| 2,975,863 | 3/1961 | Sosnowich | 55/381 |
| 3,365,864 | 1/1968 | Iizima | 55/487 |
| 3,538,686 | 11/1970 | Schwab | 55/381 |
| 3,775,951 | 12/1973 | Eicholz et al. | 55/498 |
| 3,856,489 | 12/1974 | Vokral | 55/511 |
| 4,118,208 | 10/1978 | Klinedinst | 55/DIG. 3 |
| 4,185,974 | 1/1980 | Hiester | 55/216 |
| 4,304,579 | 12/1981 | Granville et al. | 55/381 |
| 4,508,550 | 4/1985 | Berfield et al. | 55/216 |
| 4,609,387 | 9/1986 | Berfield et al. | 55/DIG. 3 |
| 4,623,366 | 11/1986 | Berfield et al. | 55/216 |

*Primary Examiner*—Jay H. Woo
*Assistant Examiner*—C. Scott Bushey
*Attorney, Agent, or Firm*—Ostrolenk, Faber, Gerb & Soffen

[57] ABSTRACT

For installing a dry material paper filter on the filter cage of an electric vacuum cleaner, a disk of porous paper filtering material or of cloth type fabric is laid over the panel enclosing the bottom of the filter cage and a ring is pressed up over the paper or cloth filter and over the panel. As the ring is drawn up over the filter cage, it folds and presses the paper or cloth filter around the filter cage. At the top of the filter cage, the ring secures the filter to the cage. An additional filtering sleeve may be disposed around the filter cage before the filter is installed over the cage and over the sleeve with the attachment ring. The sleeve may be of foam or other wet material filtering material. The filter installed with the ring is of dry filtering material, like paper or cloth. A marking or disk at the center of the filter helps a user place the filter over the filter cage before the ring is used to fold the filter into place.

2 Claims, 3 Drawing Sheets

FILTER AND INSTALLATION MEANS FOR DRY MATERIAL FILTER FOR ELECTRIC VACUUM CLEANER

BACKGROUND AND DESCRIPTION OF THE INVENTION

Tank type electric vacuum cleaners include a tank in which wet and dry materials are collected, a mixed air and collected materials inlet to the tank and an air outlet typically through the lid enclosing the tank. A filter for removing any collected wet or dry materials from the exit air stream is disposed over the outlet opening from the tank in the lid to ensure that only air exits the tank. A blow motor with a fan is supported on the lid and communicates with the outlet opening for suctioning air through the outlet opening and thereby also for sucking air and materials through the tank inlet.

A float element is supported at the lid beneath the outlet opening to seal the outlet opening when the tank has been filled, especially with collected liquid. The float element is disposed inside a cage which also provides a support for a filter so that sufficient filter surface area is exposed to the collected materials. The filter is typically removably disposed on the cage. The cage is typically a rigid plastic cage which surrounds the outlet opening and depends beneath the underside of the lid. Examples of tank type vacuum cleaners having a filter cage are seen in U.S. Pat. Nos. 4,623,366 and 4,185,974.

The cage depending from the lid, is typically circular in cross section and is generally cylindrical although it usually has a slight narrowing taper in the direction down from the lid, i.e., it is slightly conical. The bottom of the cage is defined by a closed panel. The side of the cage is defined by a plurality of widely spaced vertical struts. Around the periphery of the cage and its struts, a sleeve of foam material is installed. That foam sleeve serves as a filter for preventing wet dirt, and dirt mixed in or floating in the liquid that may fill the tank, from travelling through the foam filter. However, the foam sleeve filter is an inadequate filter for dry material, dust, or the like, typically picked off a dry surface. For filtering dry material from an air stream, a better filter medium is a paper filter, rather than a foam filter.

In presently available tank type vacuum cleaners, either with a foam cuff in place around the filter cage or even with a foam cuff not present, when dry material pick up is intended, a paper sheet of filter material of the desired porosity or a cloth sheet of filter material of the desired porosity is wrapped by the operator either around the cage or around the foam cuff already in place on the cage, and the dry paper filter or cloth filter is intended to serve as the dry material filter. The paper or cloth sheet has to be tied or belted in place to define the dry material filter. Examples of subsequently attached sealing elements for filters are shown in U.S. Pat. Nos. 3,856,489 and 945,205. These assemblies initially require that the external filter, especially a paper filter if that is used, be stretched manually from its initial placement and that it then be held in place manually while the securement device for the filter is subsequently emplaced.

Systems for stretching and placing a paper wrap over an article are known, as shown in U.S. Pat. No. 90,107. But a system for placing a vacuum cleaner filter over a filter cage or for placing and securing a filter over a cuff already in place over a filter cage is not contemplated or suggested.

SUMMARY OF THE INVENTION

Accordingly, it is the primary object of the invention to define an effective dry material filter for a filter cage of a tank type vacuum cleaner.

It is another object of the invention to ease the installation of a dry material filter and, particularly, a flexible porous paper filter, a flexible porous cloth filter, or the like, on the filter cage of an electric vacuum cleaner.

A further object of the invention is to secure the paper filter in place on the filter cage or over a cuff on the cage.

The invention uses a paper filter or cloth filter as the filter medium for dry material. Hereafter, a paper filter is discussed, but a cloth filter or even a filter of another appropriate material is contemplated. With the filter cage exposed, and with a foam cuff or a wet material filter in place or without a foam cuff over the cage in an installation where wet material is not expected, a paper generally flat sheet filter of the desired filtration porosity is generally centered over the bottom of the filter cage. Preferably, the paper filter is in the shape of a circular disk. For ease in positioning the paper disk, it may be provided with a printed or marked circle at its center so that the user would know which part of the paper disk should be overlaid on the panel at the bottom of the filter cage.

A paper filter stretching, positioning and fastening ring is provided. The ring has a diameter just large enough that it can be pulled up over the filter cage with the foam sleeve or cuff in place and the filter paper disposed over the foam cuff, but small enough that it securely presses the filter paper against the foam cuff and the cage, that is, the ring has a cross section so that it is a tight fit over the paper filter over the foam sleeve. The foam sleeve or cuff acts as a cushion and gasket to help seal against leakage. The top or leading end of the ring on its internal periphery is slightly flared outwardly so that it can more easily fit over the end of the filter cage. The user installs the ring, leading end first, by pressing it over the paper disk lying at the closed end of the filter cage and moving the ring up along the filter cage. This folds and conforms the paper filter to wrap tightly around the foam cuff. The ring is moved up preferably to the top of the filter cage where the ring is securely held by its squeezing on the paper filter, foam cuff and cage. Now the paper filter is in place tight over the cuff. Removal of the paper filter later merely requires sliding the ring down the cage and removing it from the cage.

Other objects and features of the present invention will become apparent from the following description of a preferred embodiment of the invention considered in conjunction with the accompanying drawings.

DESCRIPTION OF THE PREFERRED EMBODIMENT

The present invention is adapted for use with a lid for the tank of a tank type electric vacuum cleaner, as in U.S. Pat. Nos. 4,623,366, 4,508,550, or 4,185,974, each of which is incorporated herein by reference for its teachings with respect to vacuum cleaners and lids with filter cages. See also FIG. 5 herein.

Figure 1:
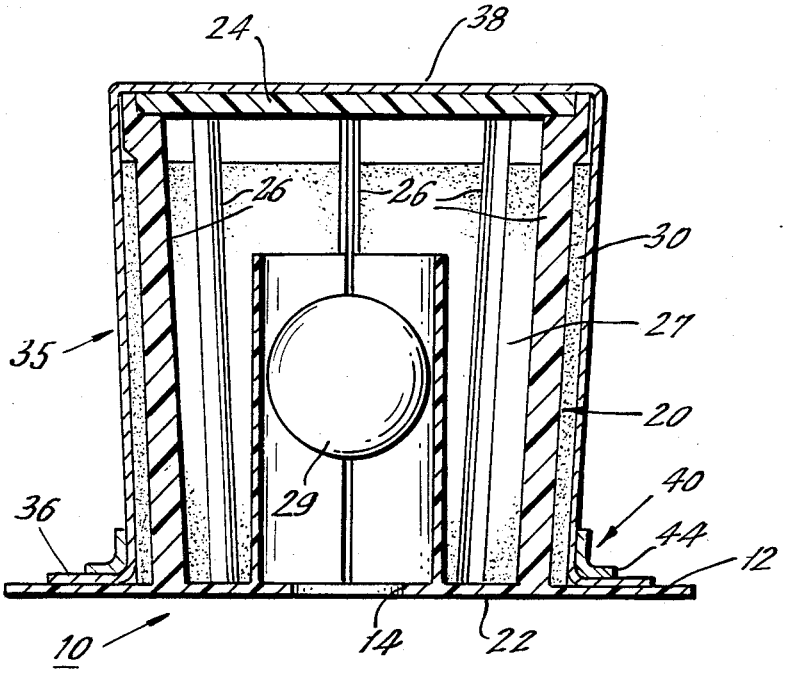
FIG. 1 is a cross-sectional, elevational view of a vacuum cleaner lid and filter cage provided with a foam cuff filter and with a paper or cloth filter and with a ring according to the invention.
Figure 3:
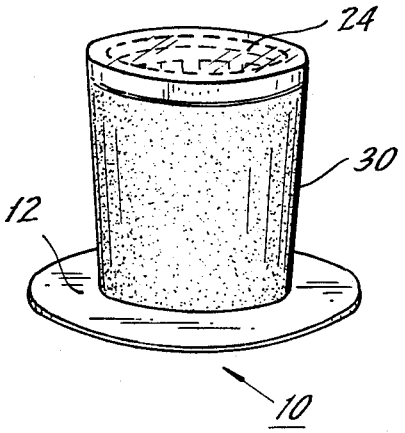
FIG. 3 is a perspective assembled view of the filter cage with the foam sleeve in place before the paper or cloth filter is installed.
Figure 4:
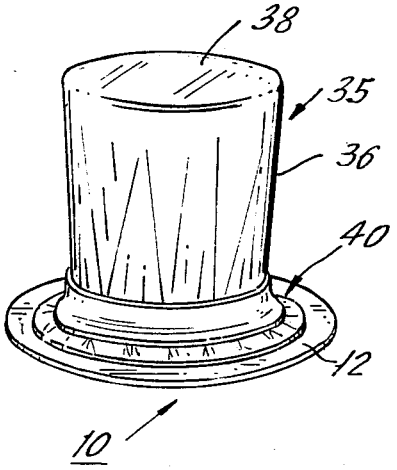
FIG. 4 is a perspective view of the lid and filter cage with the paper or cloth filter and ring installed.
Figure 2:
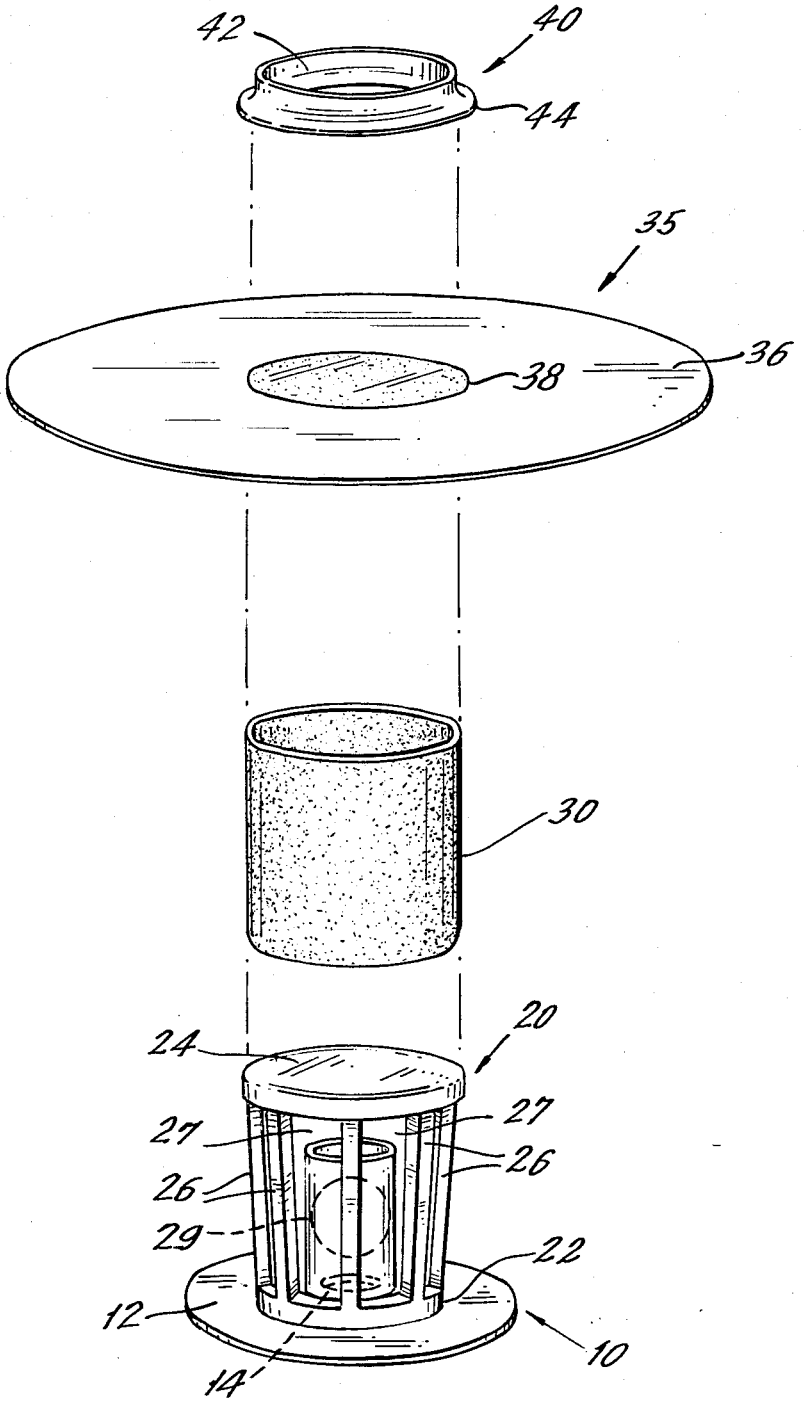
FiG. 2 is an exploded perspective thereof.
Figure 5:
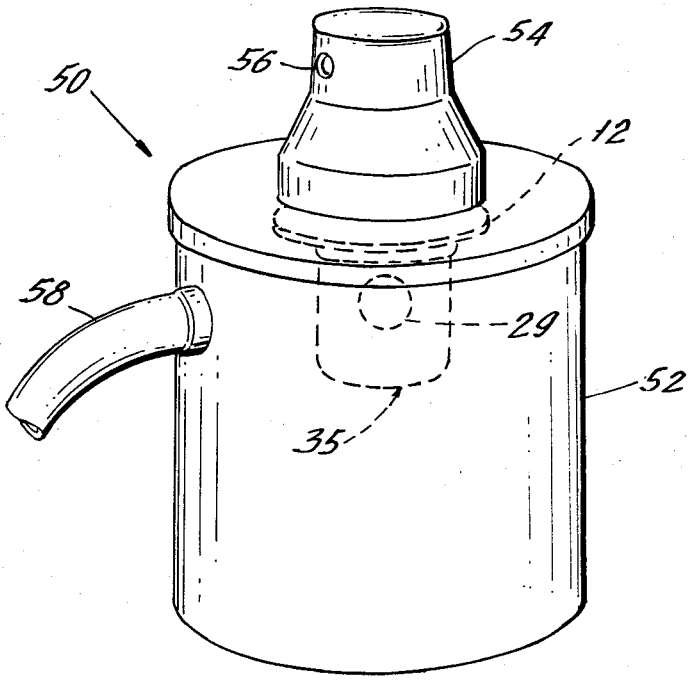
FIG. 5 is a schematic perspective view of a vacuum cleaner with the lid and filter cage.

In FIGS. 1–4, the lid 10 of the vacuum cleaner 50 is shown inverted from its normal orientation of FIG. 5 over a vacuum cleaner collection tank 52. Its inverted orientation puts the lid in position for easier mounting of the filters. The lid includes the disk top 12 which is installed over the open top of a tank (not shown) to close the tank. The lid has an opening 14 in it that defines an air outlet from the tank through the lid. A blow motor 54 communicates with the outlet 14 for suctioning air therethrough and exhausting the air through outlet 56.

The conventional filter cage 20 comprises an upper band 22 secured at the underside of the disk 12 of the lid and the outlet 14 is defined in the disk 12, a bottom panel 24, which is a solid panel and a plurality of vertical struts 26 which are circumferentially spaced apart and arrayed around the filter cage 20 and extend between the band 22 and the panel 24, thereby defining a cage with a plurality of open spaces 27 between adjacent struts 26.

The panel 24 at the bottom of the cage and the band 22 around the top have approximately the same diameter. In that event, struts 26 are straight vertical. However, in typical embodiments of a filter cage, the struts 26 taper slightly inwardly because the bottom plate 24 is of slightly smaller external diameter than the band 22. The cage is thus slightly conical. The slight conicity does not diminish the effectiveness of the foam filtering cuff 30 described below as the foam cuff is sufficiently stretchable and elastic that it will securely wrap around the entire periphery of the cage defined by the struts 26, band 22 and panel 24. On the other hand, the below described ring 40 has its internal diameter determined by the widest diameter of the filter cage. But that is still sufficient to both stretch the filter paper of disk 36 tightly and to secure it in place with the ring 40 fully installed.

The tank 52 of the et/dry pick up electric vacuum cleaner is capable of holding either collected dry materials or collected wet materials or even collected water sucked into the tank through inlet hose 58. The cage defines an enclosure for a float ball 29 which is held inside the cage by the lid 12, struts 26 and panel 24. The ball 29 closes the opening 14 when the ball floats up due to the tank being filled to a predetermined level by water. The height of the cage struts is selected so that sufficient area filtering surface is provided by the filter supported on the cage and to normally prevent the ball 29 from approaching too near to the inlet 14 during use of the vacuum cleaner.

During normal use of the vacuum cleaner when wet materials, e.g., wet dirt or even liquid which is dirty, dirty water, etc. are collected, the preferred filter medium for filtering any dirt which has not settled into the tank out of the air being suctioned through the outlet opening 14 is foam material For this filtering purpose, a conventional foam material cuff 30 or a sleeve is in place over the cage struts 26 or is drawn into place there by the user. The foam cuff is of such length that it closes the space between the panel 24 and the band 22 and closes the opening spaces 27 between the struts 26 so that any wet material which is suctioned up toward the outlet 14 or which eventually rises in the tank to surround the foam cuff would be blocked by the foam material of the cuff from passing through the cuff and into the outlet.

The vacuum cleaner 50 with which the invention may be employed can at the option of the user be used for dry pick up purposes. As has been indicated, a foam cuff is not usually as useful for filtering dry materials as it is for filtering wet materials. A paper or cloth filter 35 is more desirable for dry material filtering. Hereafter, a paper filter alone is disclosed. But, a filter of cloth or of any other appropriate filter material may be used, wherein the filter material has adequate strength and flexibility, desired porosity and the other characteristics described below.

The paper filter 35 comprises a circular disk 36 of a diameter such that with the filter on top of the bottom panel 24 of the filter cage and the paper filter folded up along the foam sleeve over the cage, as shown in FIG. 4, the paper filter will extend over the full height of the filter cage to the board 22. The paper filter is a generally flat sheet of conventional filtering paper used in electric vacuum cleaners and the like, which is a relatively stiff yet flexible paper of the desired porosity to filter dry materials out of an air stream while permitting the air to flow through it to the outlet 14 through the tank lid.

For easing installation of the paper filter over the foam cuff 30 on the filter cage 20, the center of the filter paper disk 36 is marked, as by the central disk 38, and the user can place the marking 38 center over the panel 24 at the bottom of the cage for centering the disk 36.

For applying the paper filter disk over the foam cuff, the filter placement and securement ring 40 is provided It is a ring of stiff, e.g. plastic, material having an interior 42 which is of a cross-section, and particularly a diameter, that is slightly greater than the cross-section or diameter of the filter cage at its widest end, e.g. at the band 22, but which is slightly narrower, for example, than the diameter of the foam cuff 30 when installed on the filter cage, so that when the ring 40 is drawn up over the foam sleeve, it will slightly depress the foam sleeve as it passes over it. This ensures that the paper disk is stretched tight and is also held securely in place while the foam cuff acts as a cushion and gasket to help make a non-leaky seal. A particular embodiment of vacuum cleaner may not use the foam cuff 30 or any other previously installed wet material filter. In that case, the diameter of the interior 42 of the ring is selected so as to be just slightly greater than the diameter of the widest part of the cage so that the ring will securely hold the paper filter to the cage.

The ring 40 has an upper leading end 44. That end is placed on top of the disk 36 and that end leads the movement of the ring 40 over the disk 35 for drawing the disk upward The internal periphery of the leading end 44 is slightly flared outwardly that it can more easily slip over the disk 36, cuff 30 and panel 24 on the cage as the ring 40 is installed by drawing it over the cage.

To install the paper disk 36 over the foam cuff 30 and the cage 20, the ring 40 is first placed over the disk at the panel 24 and the ring is then pushed or pulled past the panel over the cuff 30 up along the struts 26. The paper disk is folded and drawn tightly up along the exterior of the foam cuff 30 and the cage 20 until the ring reaches the widest part of the cage at the top band 22 where the ring remains. The ring compresses the foam cuff 30 and squeezes the paper disk 36 against the band 22, and the entire until is held securely together. Additional fastening means are not required for holding the entire unit assembled.

Removal of the paper filter 35 involves simply moving the ring 40 down over and then off the filter cage and removing the filter 35. If desired, the foam sleeve or cuff 30 may also be removed and replaced.

Although the present invention has been described in connection with a preferred embodiment thereof, many other variations and modifications will now become apparent to those skilled in the art without departing from the scope of the invention. It is preferred, therefore, that the present invention be limited not by the specific disclosure herein, but only by the appended claims.

What is claimed is:

1. A method of applying a filter to a cage for an electric vacuum cleaner, wherein the cage for the electric vacuum cleaner includes a top band located at the lid of the vacuum cleaner, a bottom spaced away from the top band and a plurality of struts extending between the band and the bottom, and further comprising a generally flat sheet of flexible filter material for being wrapped around the cage, the method comprising:

placing the sheet of flexible filtering material over the bottom of the cage;

applying a ring, of an internal cross section approximating the external cross section of the cage, over the sheet of filter material lying on the bottom and pressing the ring up along the cage struts for folding and drawing the filter up along the cage and moving the ring to the top band of the cage, for the ring to hold the filter at the top band of the cage.

2. The method of claim 1, wherein prior to placing the filter on the bottom of the cage, installing a sleeve over the filter cage; and the moving of the ring up over the bottom of the cage and up along the struts of the cage also folds the filter around the previously emplaced sleeve.

* * * * *